United States Patent [19]

Boundy

[11] 3,966,158

[45] June 29, 1976

[54] CANTILEVER LOCK

[75] Inventor: Bruce K. Boundy, Holland, Mich.

[73] Assignee: Westinghouse Electric Corporation, Pittsburgh, Pa.

[22] Filed: Feb. 7, 1975

[21] Appl. No.: 548,128

[52] U.S. Cl. ..... 248/243; 248/224

[51] Int. Cl.[2] ..... A47G 29/02

[58] Field of Search ..... 248/224, 243, 244, 242, 248/245

[56] References Cited

UNITED STATES PATENTS

| | | | |
|---|---|---|---|
| 3,054,511 | 9/1962 | Erismann | 248/243 |
| 3,353,684 | 11/1967 | Chesley | 248/243 |
| 3,392,848 | 7/1968 | McConnell et al. | 248/224 |
| 3,601,432 | 8/1971 | Fenwick et al. | 248/243 |
| 3,759,297 | 9/1973 | Anderson et al. | 248/243 |

*Primary Examiner*—Roy D. Frazier
*Assistant Examiner*—Darrell Marquette
*Attorney, Agent, or Firm*—B. R. Studebaker

[57] ABSTRACT

A support bracket locking mechanism for locking a cantilever support bracket which is adapted to be mounted on a slotted standard through a plurality of aligned hook connectors. The locking mechanism includes a flexible and slidable locking member having a locking tab and an actuating tab thereon. The locking tab is interposed into the series of aligned hook connectors in a position between and equidistantly spaced from two adjacent hook connectors and is movable to a position nearer one of the two adjacent hook connectors to lock the hook connectors into the slotted standard in response to movement of the actuating tab to a locked position.

5 Claims, 6 Drawing Figure

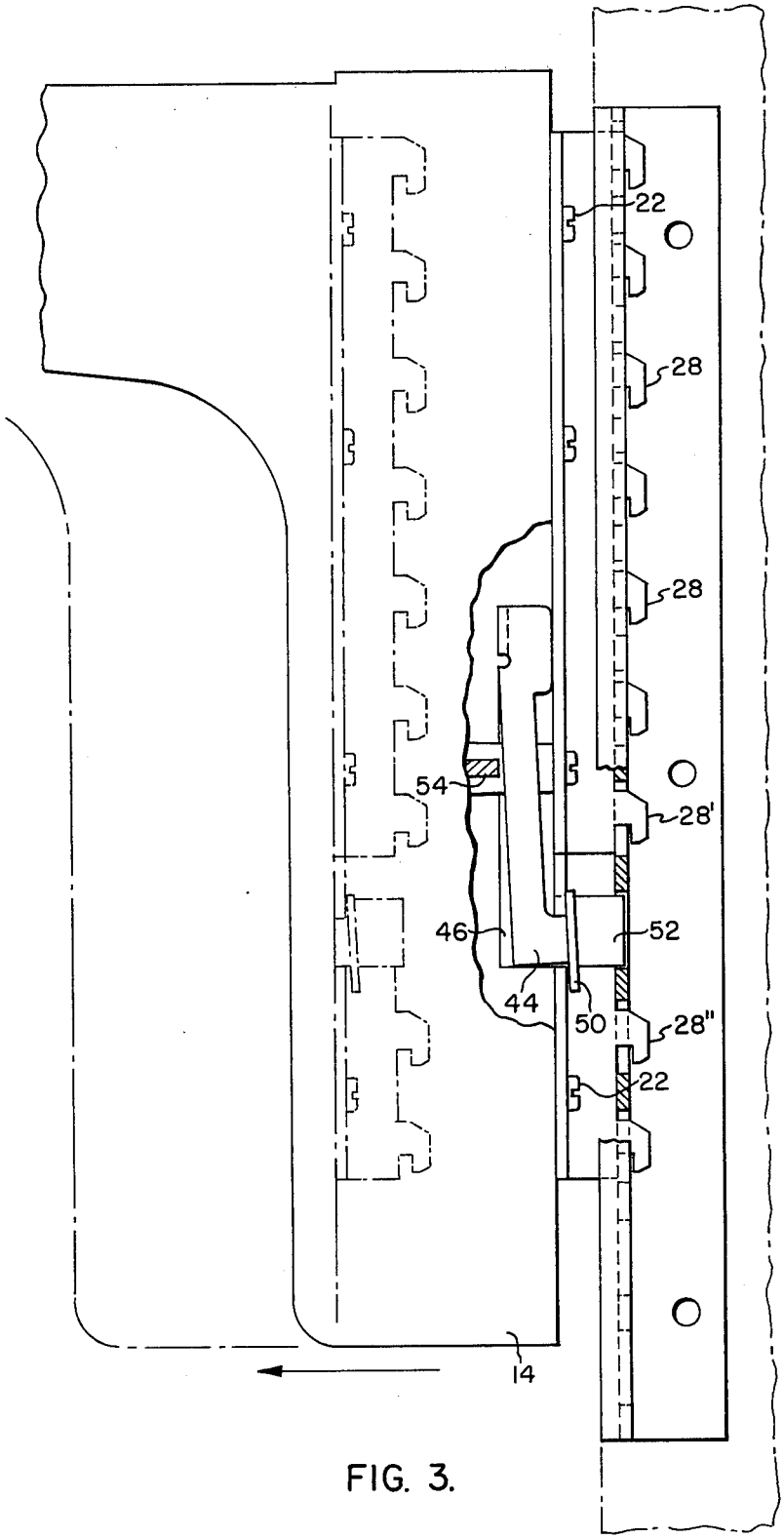
FIG. 3.
FIG. 4.
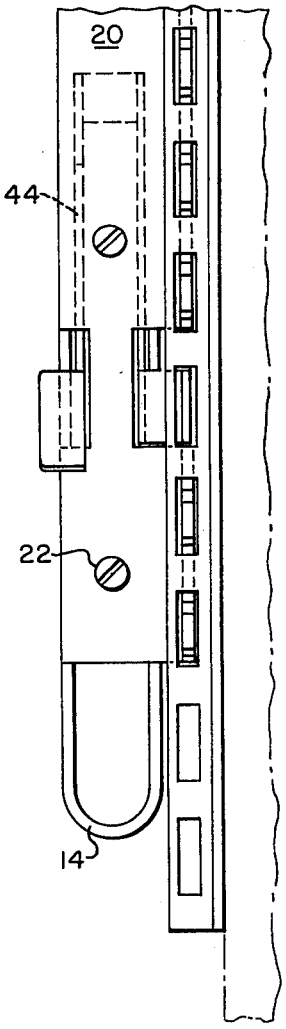

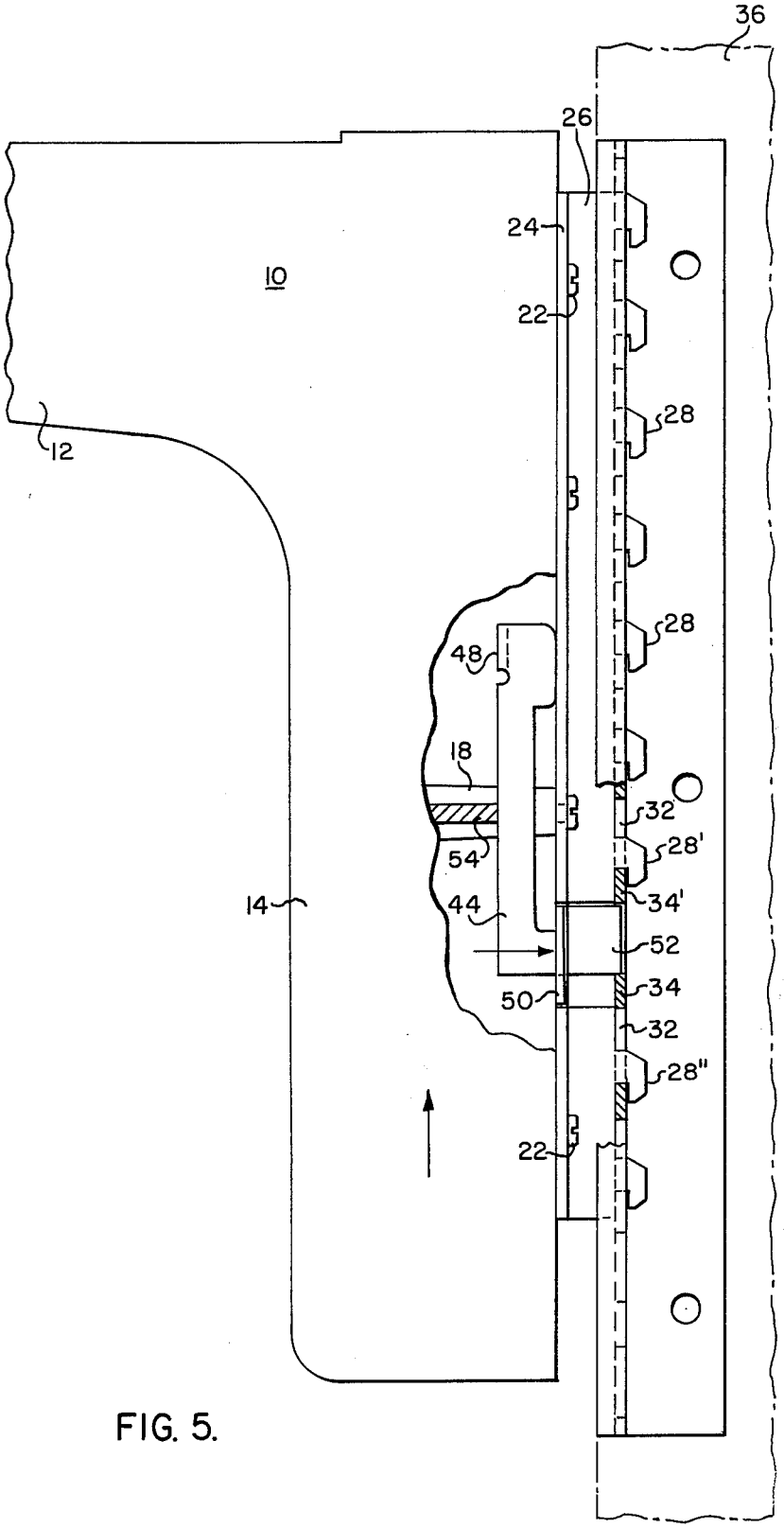
FIG. 5.
FIG. 6.
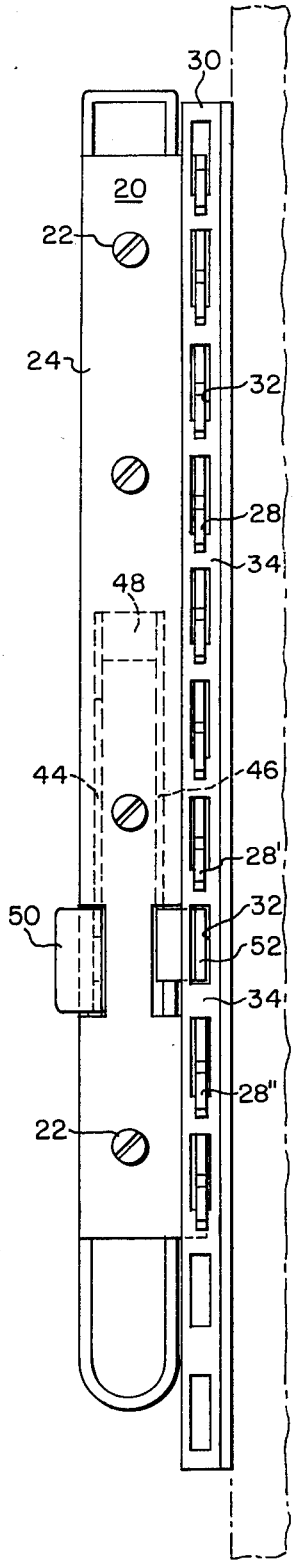

CANTILEVER LOCK

BACKGROUND OF THE INVENTION

This invention relates to cantilever support brackets which are adapted to be directly mounted to a slotted standard on a wall member, and more particularly to a positive lock mechanism for locking the cantilever support bracket to the wall panel.

It is a common practice today to mount office furniture such as desk tops, wall cabinets, book shelves filing cabinets and the like directly to the walls whether the walls be of permanent construction or of the free standing type. In many instances this is accomplished by employing a slotted standard on the wall or wall panel which cooperates with and receives a plurality of hook shaped connector elements mounted on the rearward side of the furniture mounting bracket. Heavy cantilever loads such as desk tops, shelving or filing cabinets, if jarred, may become disconnected from the slotted standard on the wall. Where the interconnection between the connectors and the slotted standard can be disassociated unintentionally at least property damage and possibly bodily injury may result. A positive locking mechanism which locks the hook connectors into the slotted standard is the only solution to this problem. A similar problem can exist when free standing wall panels are supported by lateral supports of the type illustrated in copending application Ser. No. 264,098 filed June 19, 1972 for wall panel lateral support assembly and locking mechanism therefor now issued as U.S. Pat. No. 3,794,281 and owned by the assignee of this invention. Here again, without the use of a locking mechanism to lock the hook shaped or T-shaped hook connectors into the slotted standard, the lateral support and free standing wall panel can be accidentally disassociated causing an undesirable accident.

Several kinds of locking mechanism have been employed to retain hook connectors into a slotted standard with the purpose of avoiding inadvertent disassociation of the hook connectors with the slotted standard. Although the locking mechanism disclosed in the above-identified copending application is quite effective in locking the hook connector into the slotted standard, the mechanism includes a large number of parts and is therefore more expensive to manufacture and the latch mechanism thereof can be inadvertently flipped to the unlocked position because of the non-positive set. Other locking mechanisms have also been disclosed such as that illustrated in U.S. Pat. No. 3,601,432 where a detent is pivotally moved into the slotted standard, but again, the non-positive latching provides for the easy inadvertent removal of the lock mechanism from the slot. A similar locking mechanism is disclosed in U.S. Pat. No. 3,353,684 to R. G. Chesley. The Chesley locking mechanism is again pivotal in operation and although positively locked by means of a nut and bolt, intentional disassociation of the cantilever bracket from the slotted standard requires the use of tools which may not always be available when disassociation is desired.

The optimum in a locking mechanism for a cantilever support bracket should include positive retention of the lock mechanism when a locked configuration is desired as well as ease of unlatching, without the use of tools, when and only when such unlocking is desired.

SUMMARY OF THE INVENTION

The support bracket locking mechanism of this invention exhibits positive retention of the actuating lever when the locking tab is in a locked position and it substantially eliminates the possibility of inadvertent unlocking of the locking mechanism which can lead to accidental disassociation of the supported member from the slotted standards.

The foregoing is accomplished in accordance with the present invention by providing a support bracket locking mechanism for locking a cantilever support bracket to a slotted standard, which cantilever support bracket includes an L-shaped mounting bracket secured to one edge of the support bracket along the length of one leg thereof. The L-shaped mounting bracket includes a plurality of equidistantly spaced hook shaped connectors extending from a peripheral edge of the other leg thereof. The hook shaped connectors are constructed and arranged to interconnect with a plurality of equidistantly spaced slots in the slotted standard. The mounting bracket further includes first and second adjacent notched out portions with the first notched out portion lying fully within one leg of the mounting bracket and the second notched out portion lying within both legs of the mounting bracket at their intersection. A substantially U-shaped locking member is interposed between the support bracket and the mounting bracket, which U-shaped locking member includes first and second parallel arm portions and a web portion interconnecting the arm portions. The first arm portion has an actuating tab at the end thereof remote from the interconnecting web and the other arm portion includes a locking tab at the end thereof remote from said web portion. The actuating tab is adapted to lie within the first notched out portion and the locking tab is adapted to lie within the second notched out portion and extend into one of the slots in the slotted standard. Upon sliding movement of the U-shaped locking member in response to movement of the actuating tag out of the first notched out portion the locking tab is caused to move from a locking to an unlocked position.

BRIEF DESCRIPTION OF THE DRAWING

Many of the attendant advantages of the present invention will become more readily apparent and better understood as the following detailed description is considered in connection with the accompanying drawings, in which:

FIG. 3 is a side elevational view partly in section illustrating the hook connectors and locking mechanism in an unlocked position;

FIG. 4 is a front elevational view similar to FIG. 3;

FIG. 5 is a side elevational view partly in section illustrating the hook connectors and locking mechanism in the locked position; and FIG. 6 is a front elevational view similar to FIG. 5.

DESCRIPTION OF THE PREFERRED EMBODIMENT

Figure 1:
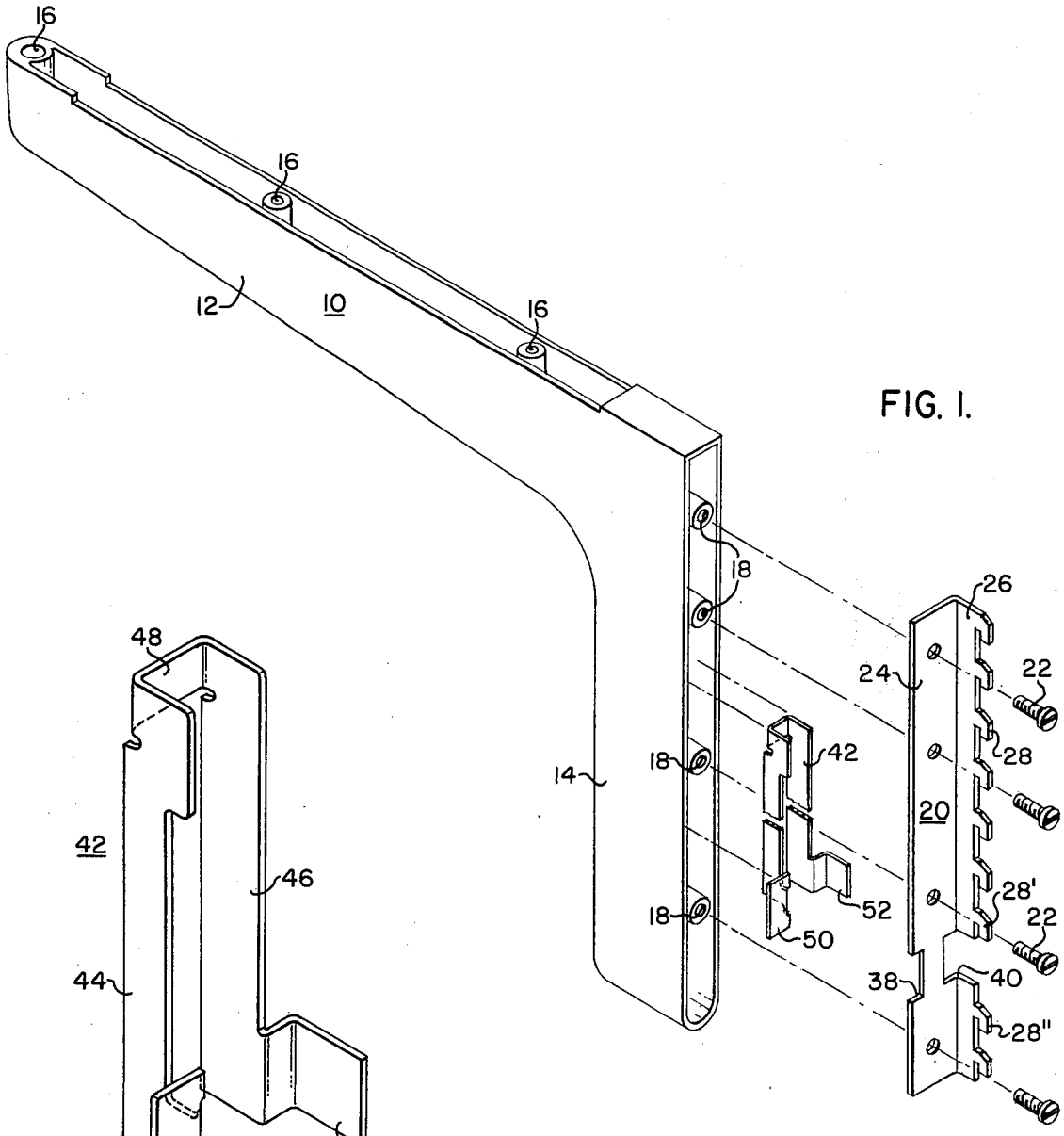
FIG. 1 is an exploded view of a cantilever support bracket including the locking mechanism of this invention.
Figure 2:
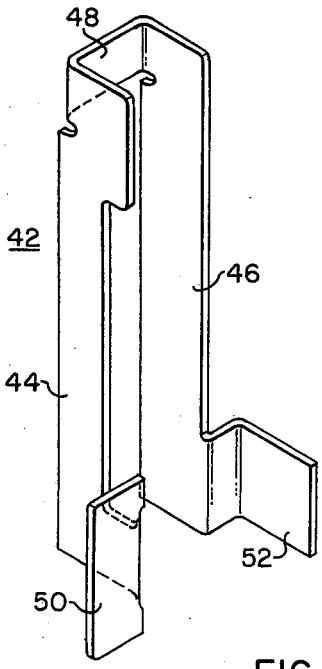
FIG. 2 is an enlarged perspective view of the locking mechanism of FIG. 1.

Referring now in detail the drawing wherein like reference characters represent like parts throughout the several views there is illustrated in FIG. 1 a cantilever support bracket employing the locking mechanism of this invention. The conventional cantilever cast support bracket 10 is generally in the form of an angle iron having a horizontally disposed leg 12 and a vertically disposed leg 14. A shelf, desk top or similar work surface may be secured to the upper edge of the leg 12 by means of the plurality of bosses 16 or in any similar fashion. A plurality of bosses 18 are provided in the vertical leg 14 and conventionally have secured thereto an L-shaped mounting bracket 20 by means of a plurality of threaded bolts 22. The L-shaped mounting bracket includes a leg 24 which is secured to the leg 14 of the support bracket 10 by means of the threaded bolts 22 and a leg 26 which includes a plurality of linearly aligned equidistantly spaced hook connectors 28 which serve to mount the cantilever support bracket 10 to a conventional slotted standard 30 (FIGS. 3–6). The conventional slotted standard 30 includes a plurality of linearly aligned equidistantly spaced slots 32 separated one from the other by spacer portions 34 of the slotted standard. The slotted standard 30 is conventionally affixed to the edge of a free standing wall panel 36 or directly to a conventional wall.

It will be apparent that the mounting bracket 20 could similarly be attached to the rear edge of a wall cabinet, filing cabinet or other similar office accessory in the same manner with which it is attached to the cantilever support bracket 10.

In accordance with the present invention the L-shaped mounting bracket 20 is provided with a pair of adjacent notched out portions 38 and 40 with the notched out portion 38 lying wholly within the first leg portion 24 while the notched out portion 40 is present in both of the legs 24 and 26 of the L-shaped mounting bracket and spans there juncture. The notched out portion 40 extends to the edge of leg 26 and therefore eliminates one of the hooked connectors in the series of linearly aligned, equidistantly spaced hook connectors 28. In accordance with this invention a generally U-shaped locking member designated 42 includes a first flexible arm 44 and a second flexible arm 46 connected together by a web portion 48. Connected to the end of the first arm portion 44 and extending in a plane perpendicular to the plane of the arm 44 is an actuating tab 50. At the end of the arm portion 46 remote from the web portion 48 is an L-shaped locking tab 52.

Referring now more particularly to FIGS. 3–6 it will be noted that the locking member 42 is situated between the leg 14 of the support bracket 10 and the plate or leg 24 of the L-shaped mounting bracket 20 with the actuating tab 50 extending through the notched out portion 38 of the leg 24 while the L-shaped locking tab 52 extends through the notch 40 and simulates the portion of the legs 24 and 26 which are notched out. The arms 44 and 46 surround one of the bosses 18 and are adapted to ride on the support flange 54 which serves to connect each of the bosses 18 to the walls of vertical leg 14. In the position of locking member 42 illustrated in FIGS. 3 and 4 the locking tab 52 is situated in a position equidistant between the hook connectors 28′ and 28″ on each side of the notched out portion 40. With the locking member 42 in this position, tab 52 along with the hook connectors 28 may be readily slipped into the plurality of equidistantly spaced slots 32 in the slotted standard 30. With the hook connectors 28 extending into the slots 32 the entire cantilever support bracket 10 is moved downwardly causing the hook connectors to hook behind the intermediate spacer portions 34 of the slotted standard 30 while at the same time the locking tab 52 remains stationary in the slot 32 and hence appears to move upwardly to a position nearer hook connector 28′ than to hook connector 28″ and the actuating tab 50 will fall into the notched out area 38 and be retained therein by the edges of the notched out portion 38 as illustrated in FIGS. 5 and 6. With the actuating tab 50 in this position the intermediate spacer portion 34′ is now locked between hook connector 28′ and locking tab 52 thus preventing the removal of any of the hook connectors 28 from their position locked behind the intermediate spacer portions 34 of the slotted standard 30.

In order to release the locking tab 52 from its locked position the actuating tab 50 must be lifted out of the notched out area 38. When this is accomplished the cantilever support bracket 10 can then be raised to a position as illustrated in FIGS. 3 and 4 so that the hook connectors 28 can be withdrawn from the slots 32 in the slotted standard 30. Because the actuating tab 50 extends beyond the side of vertical leg 14 of the cantilever support bracket 10 it is easily accessible and can be easly raised out of its position within notched out portion 38 due to the U-shaped construction of the locking member 42. This U-shaped construction including the two arm members 44 and 46 and the web portion 48 permits a flexure at the junction of web portion 48 with the arm 44 carrying actuating tab 50 as best seen in FIG. 3.

As will be apparent from the foregoing, the support bracket locking mechanism of this invention provides a positive lock which can be easily deactivated by merely lifting the actuating tab 50 out of its confinement in notched out portion 38, requires the addition of only the single U-shaped locking member 42 in addition to the conventional cantilever support bracket and a slightly modified mounting bracket 20.

What is claimed is:

1. In combination, a support bracket locking mechanism and cantilever support bracket for locking the cantilever support bracket to a slotted standard, said cantilever support bracket including an L-shaped mounting bracket attached to one edge thereof, said L-shaped mounting bracket including a plurality of spaced vertically aligned hook shaped connectors extending therefrom adapted to interconnect with a plurality of spaced slots in said slotted standard, said locking mechanism comprising; a locking member associated with said L-shaped mounting bracket and including a locking tab and an actuating tab, said locking tab constructed and arranged to extend into one of said slots in said slotted standard in place of one of said hook connectors, said actuating tab being movable with respect to said locking tab and said locking member being slidably movable, with respect to said mounting bracket, from a locked position to an unlocked position whereby said locking tab will be caused to move in response to said slidable movement of said locking member from an unlocked position equidistant between two adjacent hook connectors to a locked position closer to one of said adjacent hook connectors.

2. The combination according to claim 1, wherein said locking member comprises a pair of elongated parallel arm portions connected at adjacent ends by a web portion, said locking tab being associated with the end of one of said arm portions remote from said web portion and said actuating tab being associated with the end of the other of said arm portions remote from said web portion.

3. The combination according to claim 2, wherein said L-shaped mounting bracket includes a pair of adjacent notched out areas, said locking tab and said actuating tab being constructed and arranged to be disposed, when said locking tab is in a locked position, within said notched out areas.

4. The combination according to claim 3, wherein said actuating tab is slidably movable through the flexure of said locking member at said web portion out of one of said notched out areas to a position in part overlying said L-shaped mounting bracket to thereby move said locking tab to an unlocked position.

5. In combination, a cantilever support bracket and a support bracket locking mechanism for locking said cantilever support bracket to a slotted standard, said cantilever support bracket including an L-shaped mounting bracket secured to one edge of said support bracket along one leg thereof, said L-shaped mounting bracket including a plurality of equidistantly spaced hook shaped connectors extending from one peripheral edge of the other leg thereof constructed and arranged to interconnect with a plurality of equidistantly spaced slots in said slotted standard, said mounting bracket further including first and second adjacent notched out portions, said first notched out portion lying wholly within said one leg of said mounting bracket and said second notched out portion lying within both said one leg and said other leg of said mounting bracket, a substantially U-shaped locking member interposed between said support bracket and said mounting bracket, said U-shaped locking member including first and second parallel arm portions and a web portion interconnecting said arm portions, said first arm portion having an actuating tab at the end thereof remote from said web portion and said second arm portion having a locking tab at the end thereof remote from said web portion, said actuating tab adapted to lie within said first notched out portion and said locking tab adapted to lie within said second notched out portion and extend into one of said slots in said slotted standard whereby sliding movement of said U-shaped locking member in response to movement of said actuating tab out of said first notched out portion causes said locking tab to move from a locking to an unlocked position.

* * * * *